US009562741B2

(12) United States Patent
Corbet

(10) Patent No.: US 9,562,741 B2
(45) Date of Patent: Feb. 7, 2017

(54) CONFIGURABLE HANDGRIP

(71) Applicant: James M. Corbet, McCall, ID (US)

(72) Inventor: James M. Corbet, McCall, ID (US)

( * ) Notice: Subject to any disclaimer, the term of this patent is extended or adjusted under 35 U.S.C. 154(b) by 50 days.

(21) Appl. No.: 14/593,580

(22) Filed: Jan. 9, 2015

(65) Prior Publication Data

US 2016/0202017 A1 Jul. 14, 2016

(51) Int. Cl.
*F41C 23/16* (2006.01)

(52) U.S. Cl.
CPC ..... *F41C 23/16* (2013.01); *Y10T 16/476* (2015.01)

(58) Field of Classification Search
CPC ..... F41C 23/16; Y10T 16/44–16/516
See application file for complete search history.

(56) References Cited

U.S. PATENT DOCUMENTS 2,757,694 A * 8/1956 Curtis ..... B25D 1/00 81/22
5,375,332 A * 12/1994 Judge ..... B25D 5/00 30/167.1
2006/0185127 A1* 8/2006 Geddes ..... B25G 1/10 16/430
2011/0005790 A1* 1/2011 Frank ..... B25F 5/006 173/162.2

* cited by examiner

*Primary Examiner* — Troy Chambers
*Assistant Examiner* — Joshua Semick
(74) *Attorney, Agent, or Firm* — Bennet K. Langlotz; Langlotz Patent & Trademark Works, Inc.

(57) ABSTRACT

A configurable handgrip has a plurality of plates, the plates being arranged in a stack, a clamp element operably engaging the stack, and the clamp element being operable to transition between a first released position in which the plates are free to move with respect to each other, and a second clamped position in which the plates are secured against movement with respect to each other, such that the stack may be formed into a selected shape when the clamp is in the released position, and the plates are held in the selected shape when the clamp is in the clamped position. Each plate may define a plate aperture. The clamp element may be an elongated member received in the plate apertures. The plates may each have a contact edge and an opposed recessed edge.

19 Claims, 12 Drawing Sheets

CONFIGURABLE HANDGRIP

FIELD OF THE INVENTION

The present invention relates to handgrips for firearms, and more particularly to a device that replaces the standard factory-supplied firearm handgrip without requiring significant modification of the firearm and enhances the functionality of the firearm by providing a handgrip that can be configured for a customized and adjustable fit.

BACKGROUND OF THE INVENTION

Standard factory-supplied firearm handgrips may include ergonomic features such as finger ridges and palm swells to provide adequate security for holding the gun during recoil, but many do not. For those that do, the ergonomic features are fixed in position, making it impossible for the features to precisely match every user's hand. Users with larger or smaller hands than average may even find the ergonomic features uncomfortable because the features' locations poorly match the users' hand. In addition, users with large hands may need a larger grip circumference than the standard factory-supplied firearm handgrip, and users with small hands may need a smaller grip circumference than the standard factory-supplied firearm handgrip.

Therefore, a need exists for a new and improved configurable handgrip that provides that provides a customizable fit to the user's hand. In this regard, the various embodiments of the present invention substantially fulfill at least some of these needs. In this respect, the configurable handgrip according to the present invention substantially departs from the conventional concepts and designs of the prior art, and in doing so provides an apparatus primarily developed for the purpose of providing a configurable handgrip that can be customized to enable a more secure grip by the user.

SUMMARY OF THE INVENTION

The present invention provides an improved configurable handgrip, and overcomes the above-mentioned disadvantages and drawbacks of the prior art. As such, the general purpose of the present invention, which will be described subsequently in greater detail, is to provide an improved configurable handgrip that has all the advantages of the prior art mentioned above.

To attain this, the preferred embodiment of the present invention essentially comprises a plurality of plates, the plates being arranged in a stack, a clamp element operably engaging the stack, and the clamp element being operable to transition between a first released position in which the plates are free to move with respect to each other, and a second clamped position in which the plates are secured against movement with respect to each other, such that the stack may be formed into a selected shape when the clamp is in the released position, and the plates are held in the selected shape when the clamp is in the clamped position. Each plate may define a plate aperture. The clamp element may be an elongated member received in the plate apertures. The plates may each have a contact edge and an opposed recessed edge. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
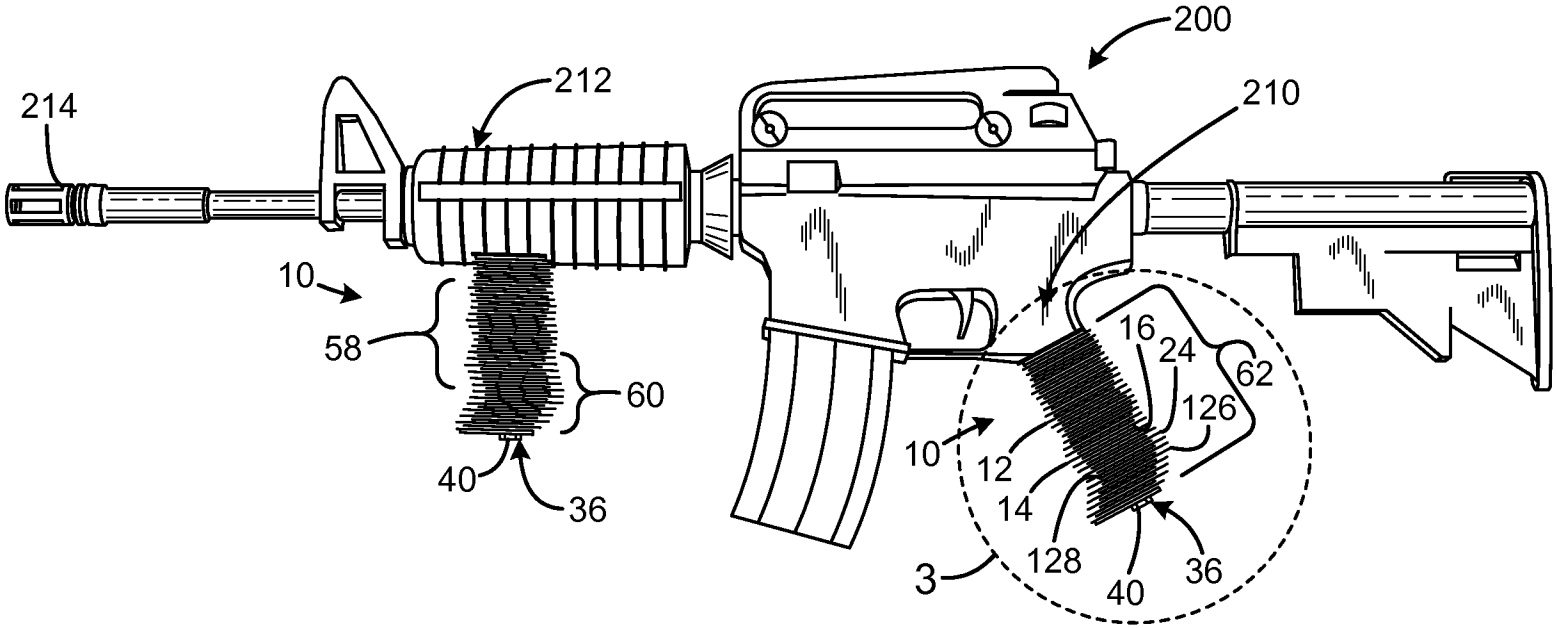
FIG. 1 is a side view of the current embodiment of a configurable handgrip constructed in accordance with the principles of the present invention installed on the lower receiver and forend of a firearm.

An embodiment of the configurable handgrip of the present invention is shown and generally designated by the reference numeral 10.

Figure 2:
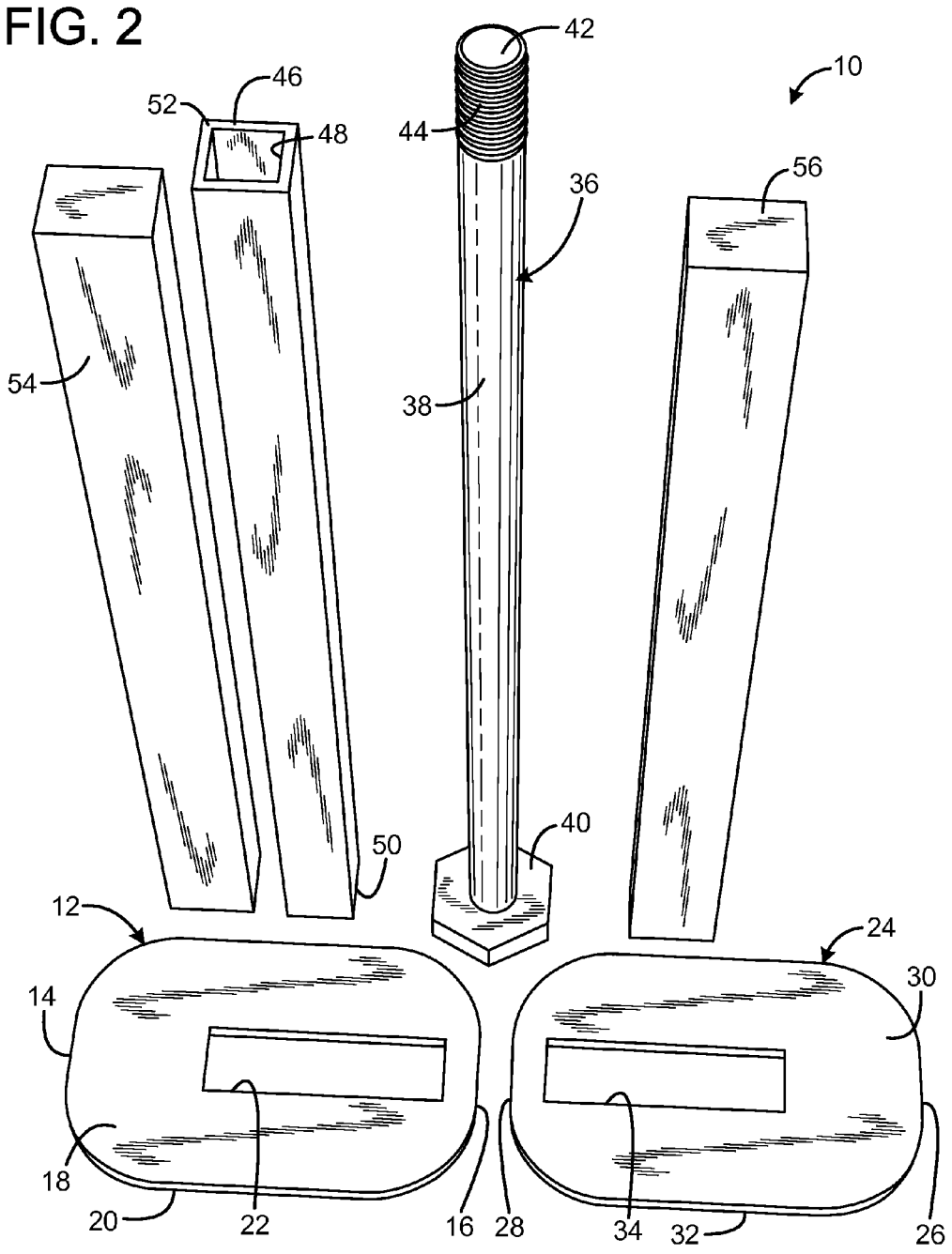
FIG. 2 is an exploded view of the current embodiment of the configurable handgrip of FIG. 1.
Figure 3:
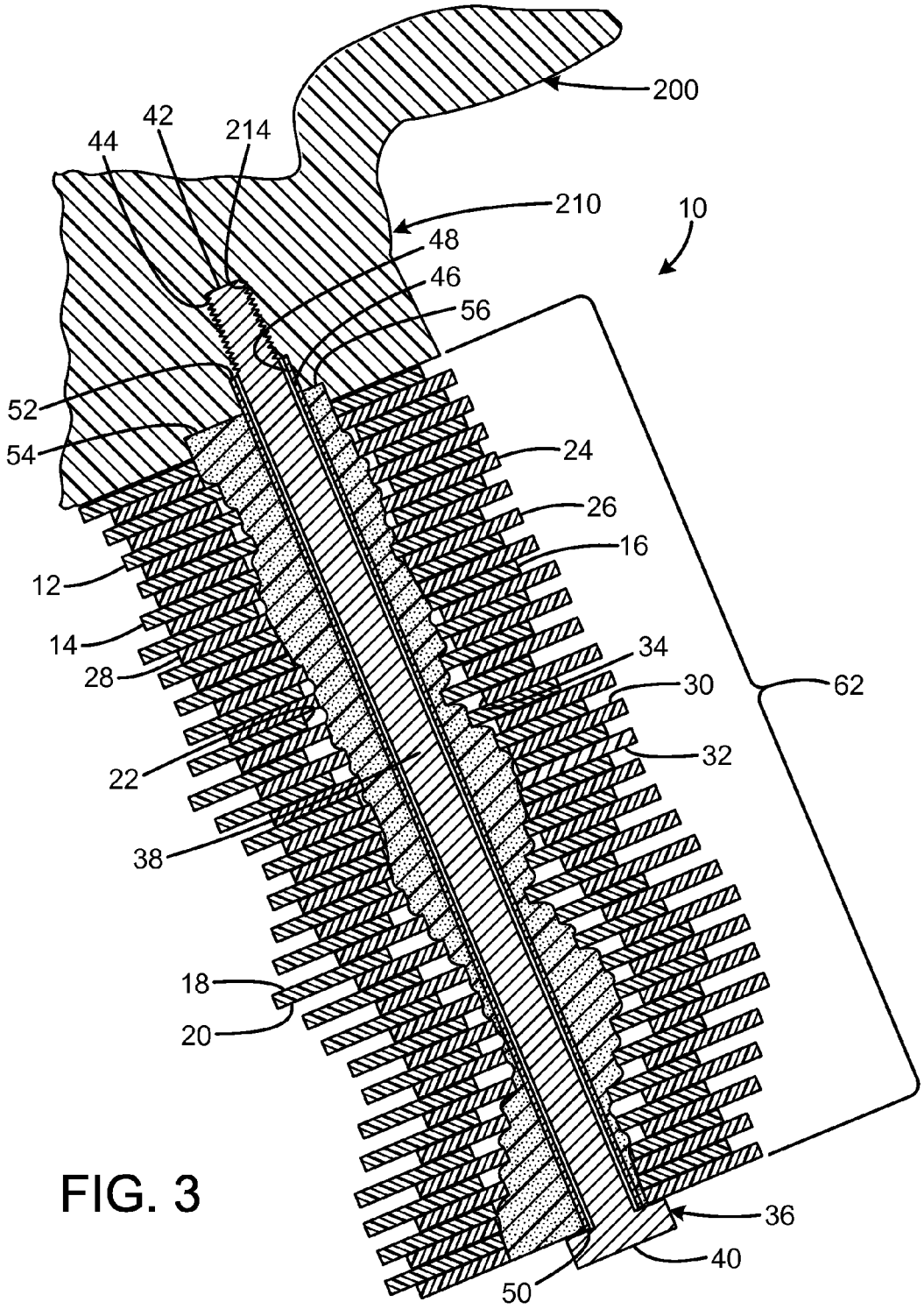
FIG. 3 is an enlarged view of the configurable handgrip of FIG. 1 denoted by the circled portion 3.

FIGS. 1-3 illustrate the improved configurable handgrip 10 of the present invention. More particularly, two handgrips 10 are shown attached to a firearm 200 having a muzzle 214 in FIG. 1. One handgrip is attached to the lower receiver 210, and one handgrip is attached to the forend 212. Each handgrip has a stack of alternating front plates 12 and rear plates 24. The front and rear plates can be slid forward and rearward to create customized ergonomic features, such as finger ridges 58 and palm swells 60, which precisely fit a user's hand. An elongated member 36 having a head 40 clamps each stack of plates into a fixed position between the head and the firearm once the desired ergonomic features are created. In the current embodiment, firearm 200 is a semi-automatic rifle.

The elongated member 36 has a shaft 38 with the head 40 connected at one end and an opposed threaded end 42 with threads 44. A square tube 46 having a central bore 48 is fitted over the shaft 38 such that the bottom 50 of the square tube contacts the head, and the top 52 of the square tube terminates below the threads such that the threads are exposed. A front foam 54 and a rear foam 56 are positioned to abut the square tube 46 such that the front foam, square tube, and rear foam form an elongate rectangle.

The front plates 12 and rear plates 24 each have longitudinally offset rectangular plate apertures 22, 34 that are sized to closely receive the front foam 54, square tube 46, and rear foam 56. The front plates each have a forward facing contact edge 14, a rearward facing recessed edge 16, a top 18, and a bottom 20. The rear plates each have a rearward facing contact edge 26, a forward facing recessed edge 28, a top 30, and a bottom 32. The front and rear plates are identical to facilitate manufacturing and only differ in orientation by being rotated 180° when they are assembled into a stack 62 in an alternating manner. In the current embodiment, the front and rear plates are essentially oblong with a race track/rectangle with rounded corners shape and can be made of plastic, metal, or any suitable composite material.

When the front plates 12 and rear plates 24 are initially assembled into a stack 62 on the shaft 38 of the elongate member 36, the front foam 54, square tube 46, and rear foam 56 are self-centering and urge the front and rear plates into a uniform neutral rest position arrangement with the square tube centered within the plate apertures 22, 34 and the contact edges 14, 26 extending outward over the recessed edges 16, 28. Lateral movement of the front and rear plates is tightly constrained by the sides of the square tube. However, the plates' tops 18, 30 and bottoms 20, 32 are free to slide forward and rearward with respect to one another as pressure is applied to their contact edges. As a result, customized ergonomic features such as finger ridges 58 and palm swells 60 can be created by a user by squeezing the front and rear plates to compress the front and rear foam to move the front and rear plates into the desired compressed position custom configuration.

In order to secure the front plates 12 and rear plates 24 in the desired custom configuration, and to attach the stack 62 to the firearm 200, the threads 44 on the threaded end 42 of the elongated member 36 are inserted into a threaded bore 214 in the lower receiver 210. The elongated member is tightened until the stack 62 of plates is firmly clamped between the head 40 and the lower receiver. When sufficient clamping force is applied, friction between the tops 18, 30 and bottoms 20, 32 of the front and rear plates increases to the point that squeezing the front and rear plates no longer will move the plates.

To facilitate the creation of a customized configuration of the stack 62 of front and rear plates 12, 24, the user may first loosely engage the threads 44 on the threaded end 42 of the elongated member 36 with the threaded bore 214 in the lower receiver 210 such that insufficient clamping force is applied to hold the plates in position. The user may then squeeze the front and rear plates into the desired configuration, and then firmly tighten the elongated member to create sufficient clamping force to prevent additional plate movement. The same procedure would apply when attaching an additional handgrip 10 to the forend 212 of the firearm 200. The threaded bore in the forend is not shown.

Figure 4:
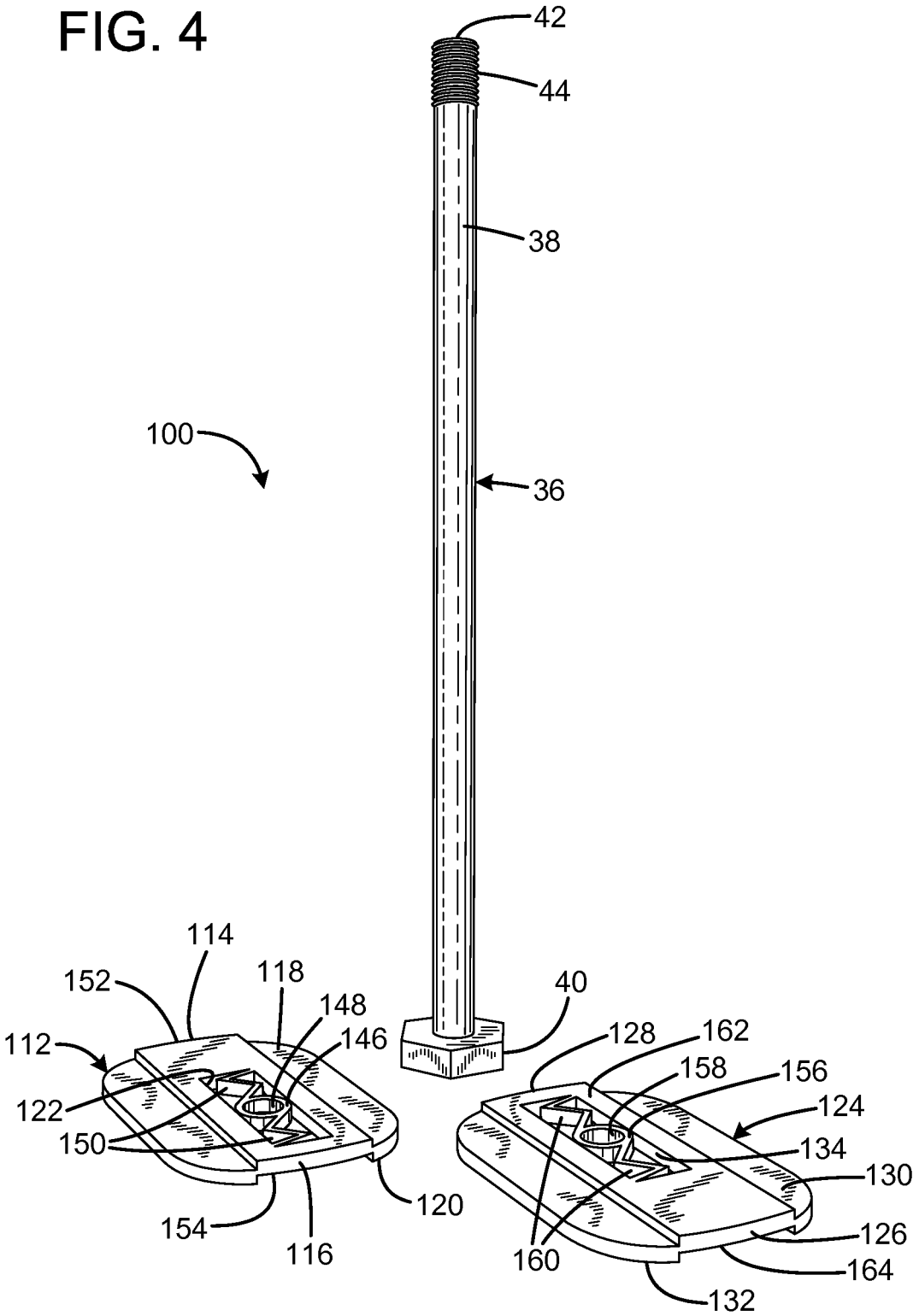
FIG. 4 is an exploded view of an alternative embodiment of the configurable handgrip constructed in accordance with the principles of the present invention.
Figure 5:
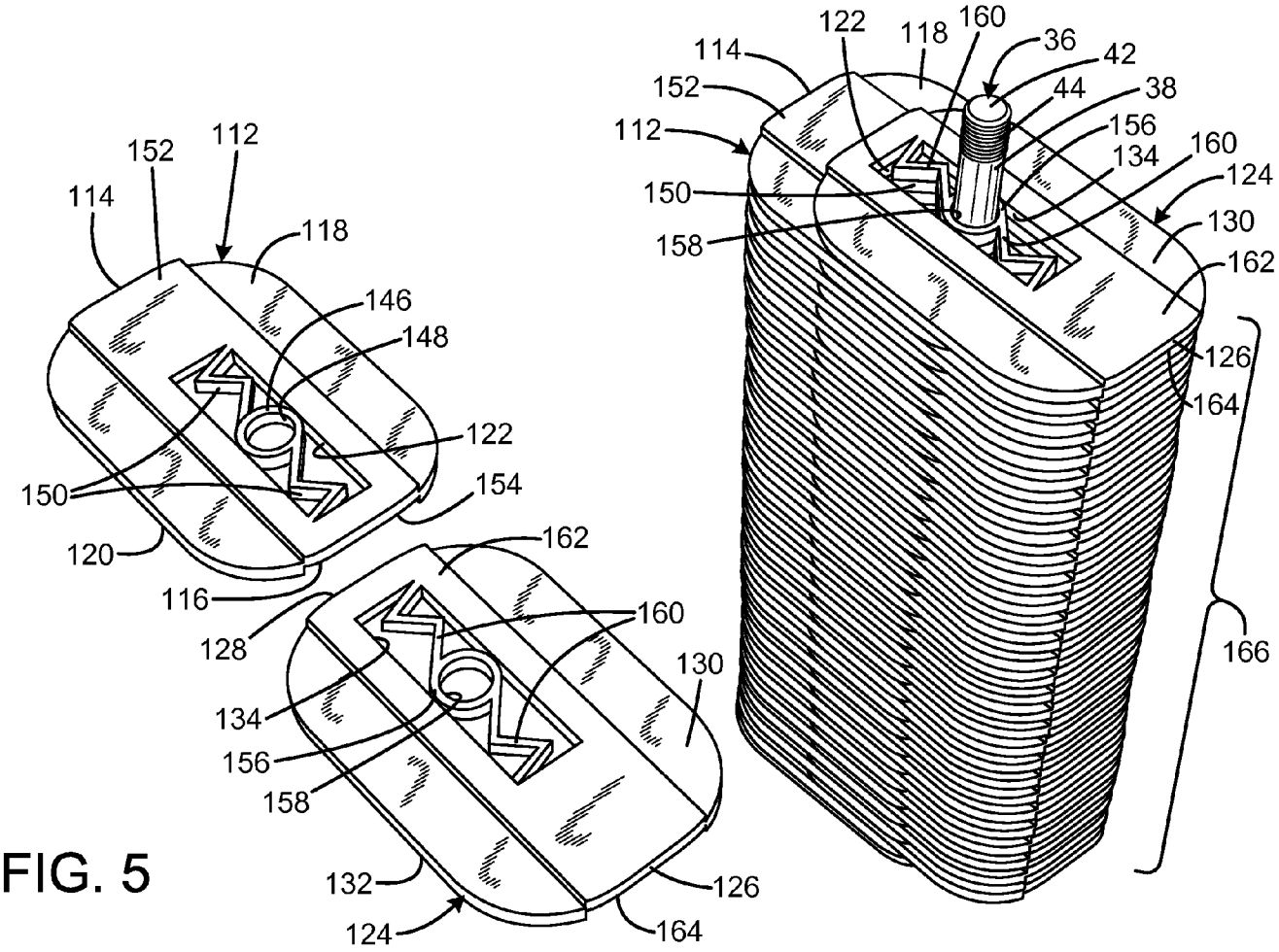
FIG. 5 is a top isometric view of the configurable handgrip of FIG. 4.
Figure 6:
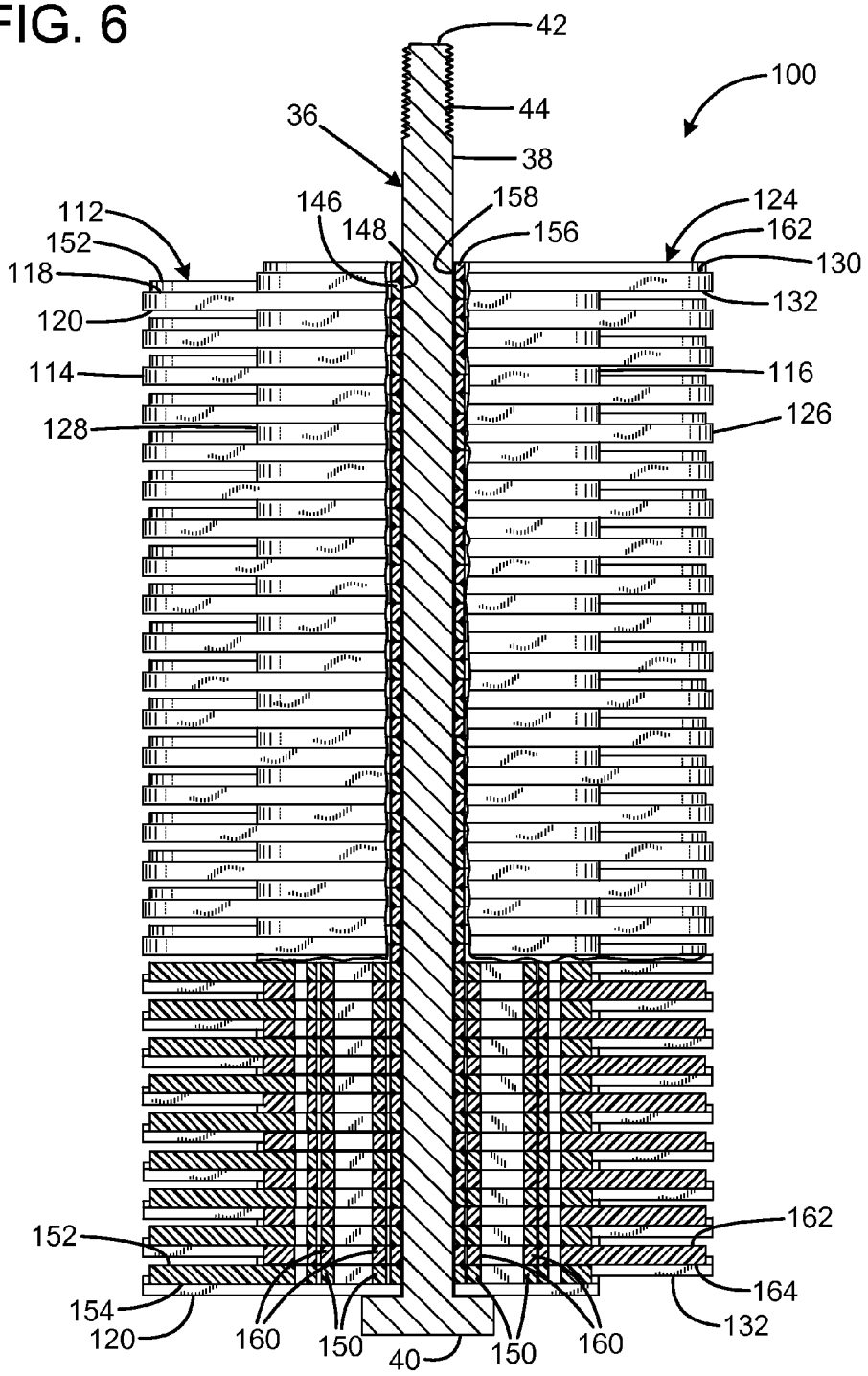
FIG. 6 is a side sectional view of the configurable handgrip of FIG. 4.

FIGS. 4-6 illustrate an alternative embodiment of the improved configurable handgrip 100 of the present invention. More particularly, the handgrip 100 has a stack of alternating front plates 112 and rear plates 124. The front and rear plates can be slid forward and rearward to create customized ergonomic features, such as finger ridges and palm swells, which precisely fit a user's hand. An elongated member 36 having a head 40 clamps each stack of plates into a fixed position between the head and the rifle once the desired ergonomic features are created.

The elongated member 36 has a shaft 38 with the head 40 connected at one end and an opposed threaded end 42 with threads 44. The front plates 112 and rear plates 124 each have longitudinally offset rectangular plate apertures 122, 134 that receive a shaft ring 146, 156 with an aperture 148, 158. The shaft rings are held within the plate apertures by dual leaf springs 150, 160. The shaft rings are free to move forward and rearward within the limits imposed by the dual leaf springs, but are tightly constrained laterally by the sides of the plate apertures. The apertures of the shaft rings are sized to closely receive the shaft of the elongated member when the plates are assembled into a stack 166.

The front plates 112 each have a forward facing contact edge 114, a rearward facing recessed edge 116, a top 118, a bottom 120, an upwardly extending central dovetail ridge 152, and a central bottom dovetail slot 154. The rear plates 124 each have a rearward facing contact edge 126, a forward facing recessed edge 128, a top 130, a bottom 132, an upwardly extending central dovetail ridge 162, and a central bottom dovetail slot 164. The dovetail slots are sized to closely receive the dovetail ridges. The front and rear plates are identical to facilitate manufacturing and only differ in orientation by being rotated 180° when they are assembled into a stack 166 in an alternating manner. In the current embodiment, the front and rear plates are essentially oblong with a race track/rectangle with rounded corners shape. The front and rear plates can be molded in one piece with the dual leaf springs and shaft ring included.

When the front plates 112 and rear plates 124 are initially assembled into a stack 166 on the shaft 38 of the elongate member 36, the shaft rings 146, 156 and dual leaf springs 150, 160 are self-centering and urge the front and rear plates into a uniform neutral rest position arrangement with the shaft rings centered within the plate apertures 122, 134 and the contact edges 114, 126 extending outward over the recessed edges 116, 128. Lateral movement of the front and rear plates is tightly constrained by the interaction of the dovetail ridges 152, 162 with the sides of the dovetail slots 154, 164. However, the plates' tops 118, 130 and bottoms 120, 132 are free to slide forward and rearward with respect one another as pressure is applied to their contact edges. As a result, customized ergonomic features such as finger ridges and palm swells can be created by a user by squeezing the front and rear plates to expand and compress the dual leaf springs to move the front and rear plates into the desired compressed position custom configuration.

In order to secure the front plates 112 and rear plates 124 in the desired custom configuration, and to attach the stack 166 to the firearm 200, the threads 44 on the threaded end 42 of the elongated member 36 are inserted into a threaded bore 214 in the lower receiver 210. The elongated member is tightened until the stack 166 of plates is firmly clamped between the head 40 and the lower receiver. When sufficient clamping force is applied, friction between the tops 118, 130 and bottoms 120, 132 of the front and rear plates increases to the point that squeezing the front and rear plates no longer will move the plates.

To facilitate the creation of a customized configuration of the stack 166 of front and rear plates 112, 124, the user may first loosely engage the threads 44 on the threaded end 42 of the elongated member 36 with the threaded bore 214 in the lower receiver 210 such that insufficient clamping force is applied to hold the plates in position. The user may then squeeze the front and rear plates into the desired configuration, and then firmly tighten the elongated member to create sufficient clamping force to prevent additional plate movement. The same procedure would apply when attaching an additional handgrip 100 to the forend 212 of the firearm 200. The threaded bore in the forend is not shown.

Figure 7:
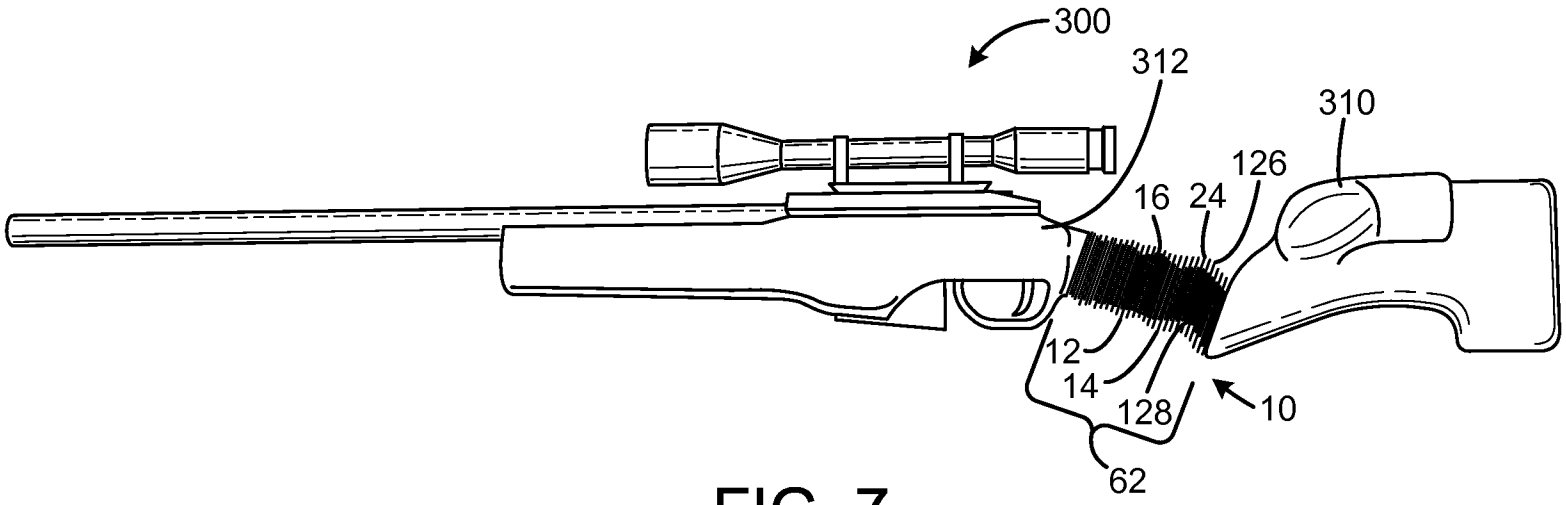
FIG. 7 is a side view of the configurable handgrip of FIG. 1 installed on a bolt action rifle.
Figure 8:
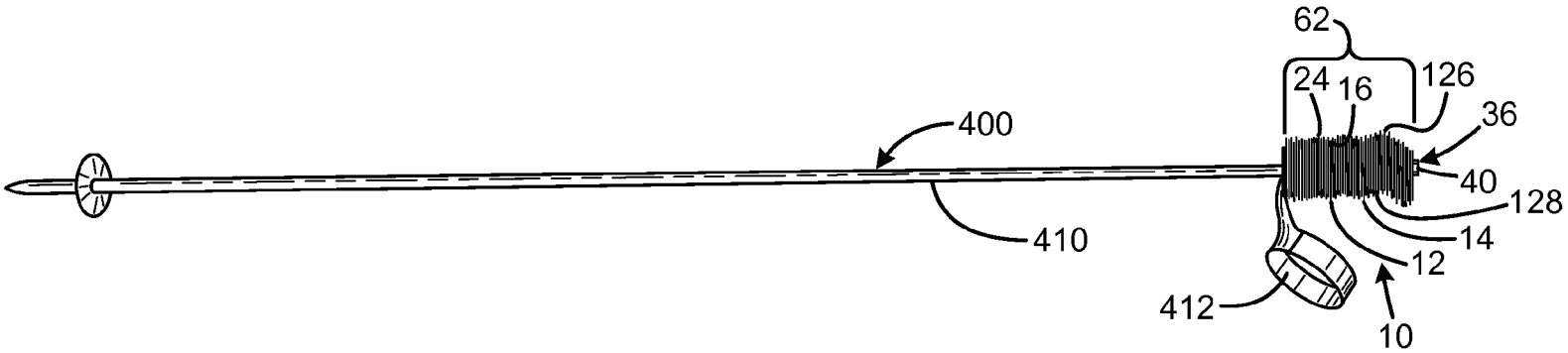
FIG. 8 is a side view of the configurable handgrip of FIG. 1 installed on a ski pole.
Figure 9:
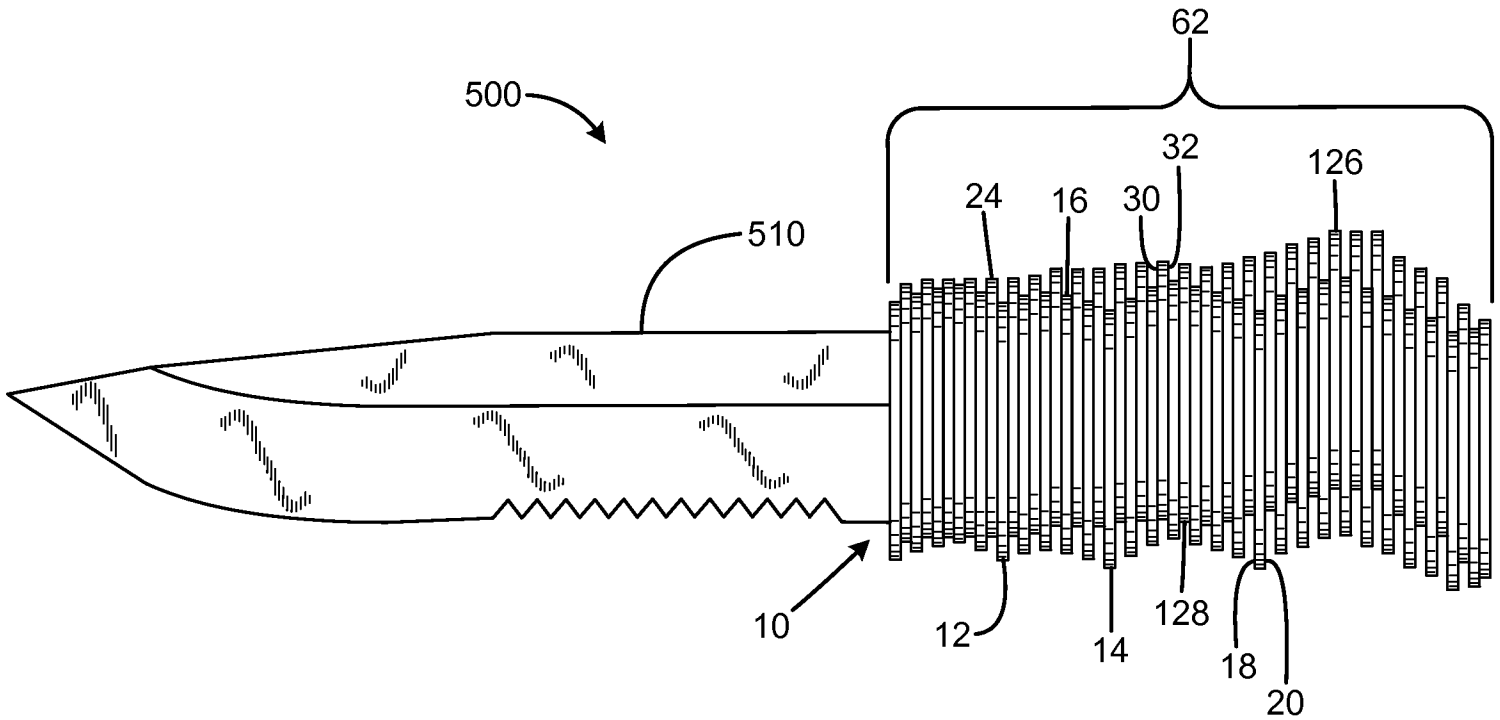
FIG. 9 is a side view of the configurable handgrip of FIG. 1 installed on a knife.
Figure 10:
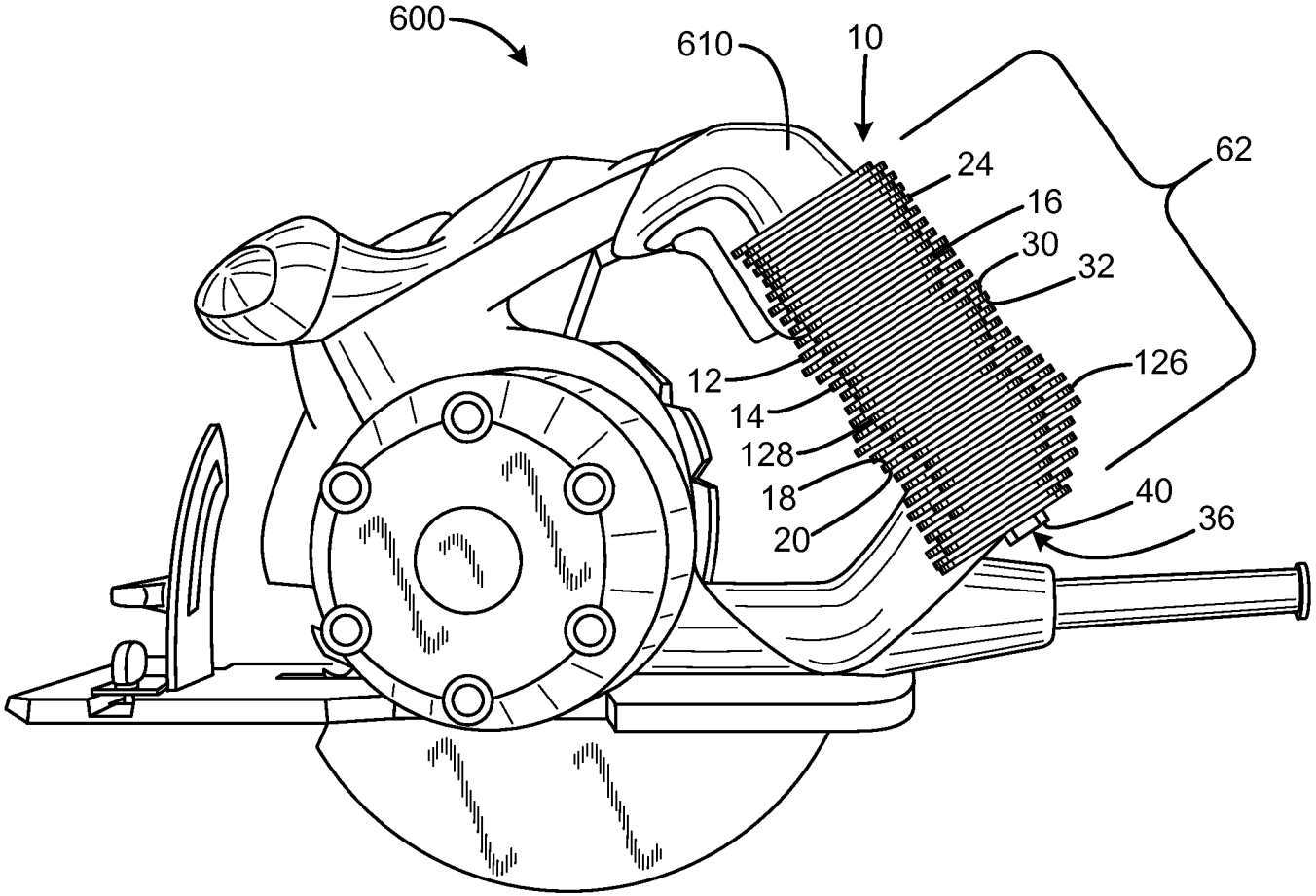
FIG. 10 is a side view of the configurable handgrip of FIG. 1 installed on a circular saw.
Figure 11:
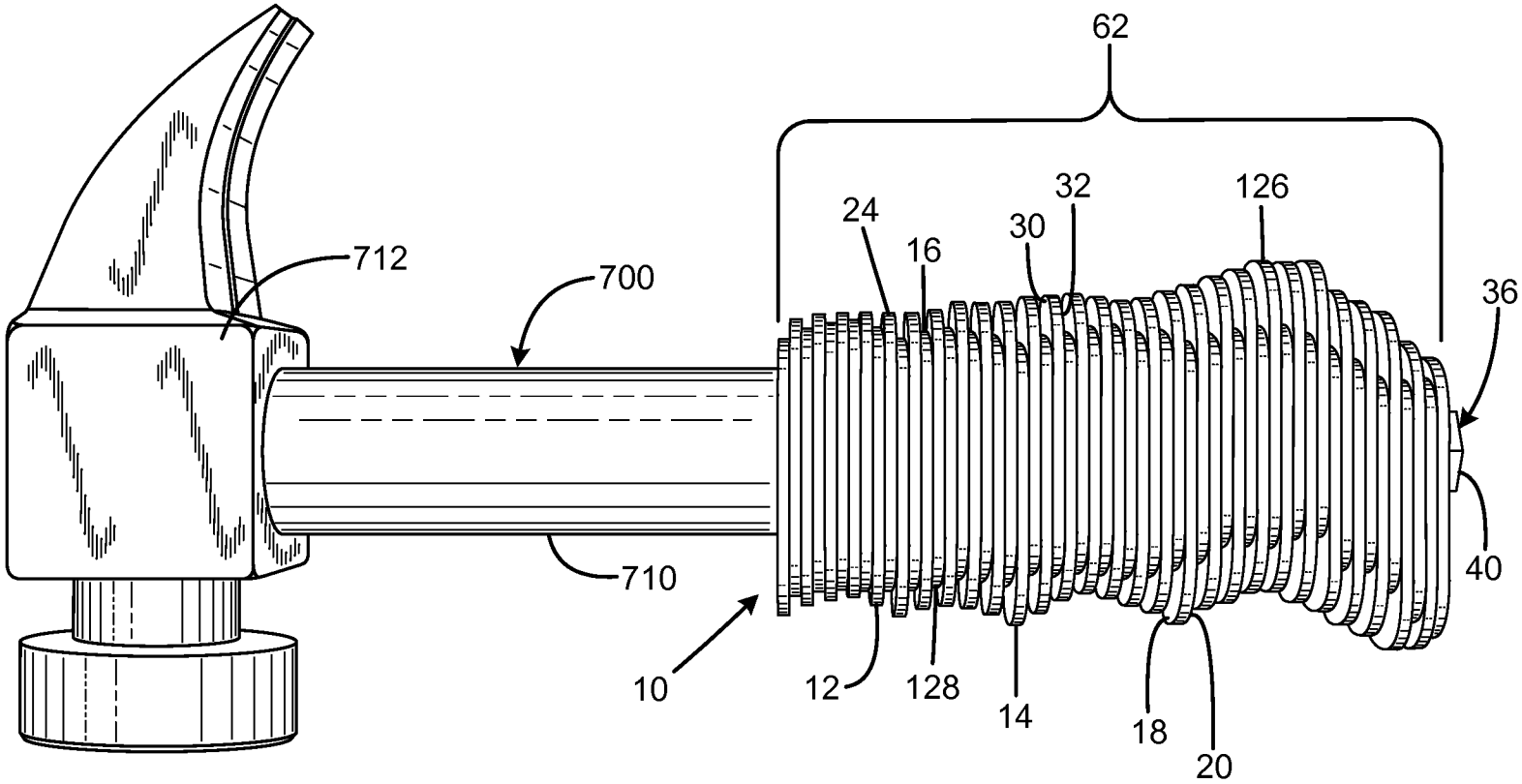
FIG. 11 is a side view of the configurable handgrip of FIG. 1 installed on a hammer.
Figure 12:
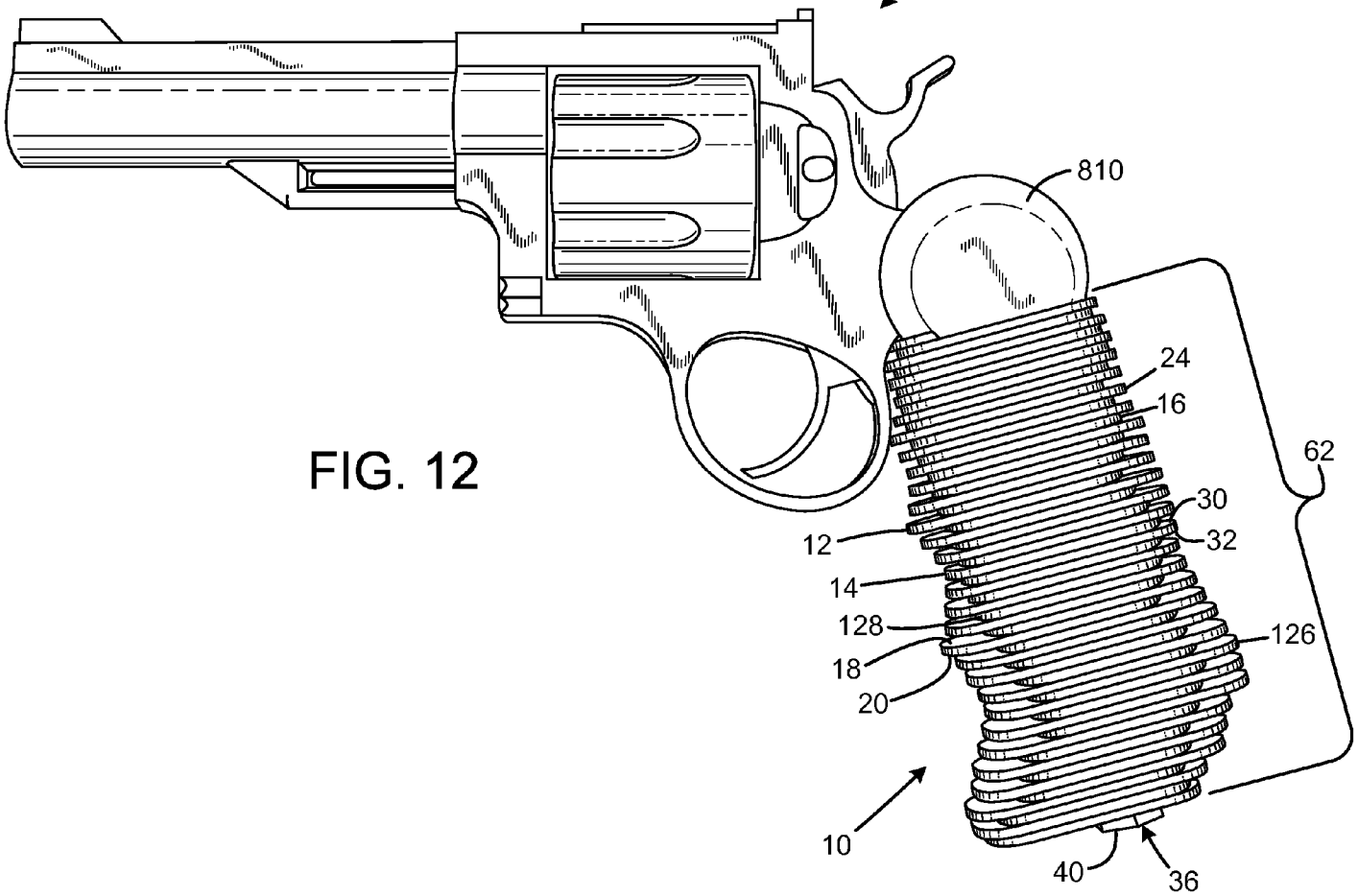
FIG. 12 is a side view of the configurable handgrip of FIG. 1 installed on a handgun.

FIGS. 7-12 illustrate additional applications of the improved configurable handgrip 10 of the present invention present invention. More particularly, although the handgrip 10 is depicted, the alternative handgrip 100 can also be used in these applications. In FIG. 7, the handgrip is used to connect the stock 310 to the receiver 312 of the bolt action rifle 300 and provides a customizable gripping surface for the user's shooting hand. In FIG. 8, the handgrip is used to connect a wrist strap 412 to one end of a shaft 410 of a ski pole 400 and provides a customizable gripping surface for the user's hand. In FIG. 9, the handgrip is attached to one end of a blade 510 of a knife 500 and provides a customizable gripping surface for the user's cutting hand. In FIG. 10, the handgrip is connected to a handle 610 of a circular saw 600 and provides a customizable gripping surface for the user's sawing hand. In FIG. 11, the handgrip is connected to one end of a shaft 710 of a hammer 700 having a head 712 and provides a customizable gripping surface for the user's hand that swings the hammer. In FIG. 12, the handgrip is attached to one end of a grip frame 810 of a handgun 800 and provides a customizable gripping surface for the user's shooting hand. In the current embodiment, handgun 800 is a revolver.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a configurable handgrip has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, while semi-automatic rifles as described are the most likely contemplated application for the concepts of the present invention, it should be appreciated that the current invention could be used with any firearm grip, including revolvers and pistols, as well as hand and power tools and other implements with a handgrip. Furthermore, an elastomeric sleeve could be placed over the stack of plates or friction tape could be wrapped around the stack of plates to bridge the gaps between the plates and provide a continuous surface. Also, the plates could be arranged in more than two axes spiraling right, front, back, and left to create ergonomic features on the left and right sides of the stack in addition to the front and back of the stack. And, although replacing the standard factory-supplied firearm handgrip has been described, it should be appreciated that the configurable handgrip herein described is also suitable for being installed as a factory-supplied handgrip.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A configurable handgrip comprising:

a plurality of plates;

the plates being arranged in a stack;

each plate defining a plate aperture;

an elongated clamp element operably engaging the stack and received by each of the plate apertures;

the each plate aperture having a selected width, and the clamp element having a clamp width less than the selected width such that the plates are loosely constrained against transverse movement by interaction of the clamp and the plate apertures; and the clamp element being operable to transition between a first released position in which the plates are free to move transversely with respect to each other, and a second clamped position in which the plates are secured against movement with respect to each other, such that the stack may be formed into a selected shape when the clamp is in the released position, and the plates are held in the selected shape when the clamp is in the clamped position.

2. The configurable handgrip of claim 1 wherein the plates each have a contact edge and an opposed recessed edge, and wherein the contact edge of each plate extends farther from the plate aperture than the recessed edge extends from the plate aperture.

3. The configurable handgrip of claim 1 wherein the elongated member is threaded at one end to secure the grip to a device.

4. The configurable handgrip of claim 3 wherein the elongated member has a head at an end opposite the threaded end, such that when the clamp is in the clamped position the stack is compressed between the head and a body into which the threaded end is secured.

5. The configurable handgrip of claim 3 wherein the threaded end is adapted to mate with a threaded bore of a firearm.

6. The configurable handgrip of claim 1 wherein each of the plates is the same shape as the other plates.

7. The configurable handgrip of claim 1 wherein each plate defines a plate plane and includes a spring element operable to bias the plate in a selected direction along the plate plane.

8. The configurable handgrip of claim 1 wherein the plates each have an orienting feature, and wherein the plates are stacked in alternating configuration with a first subgroup of plates interleaved with a second subgroup of plates, and wherein the orienting feature of the first subgroup is oriented in a first orientation, and the orienting feature of the second subgroup is oriented in a different second direction.

9. The configurable handgrip of claim 8 wherein the first orientation is opposite the second direction.

10. The configurable handgrip of claim 8 wherein the orienting feature is a spring having a biasing direction.

11. The configurable handgrip of claim 8 wherein the plates each have a contact edge and an opposed recessed edge, and wherein the contact edge of each plate extends beyond the recessed edge of an adjacent plate in the stack.

12. The configurable handgrip of claim 11 wherein the contact edges of the first subgroup form a configurable front strap of a grip, and the contact edges of the second subgroup form a configurable back strap of a grip.

13. The configurable handgrip of claim 12 wherein the shape of the front strap and the shape of the back strap are independent of each other.

14. A firearm having a configurable handgrip comprising:

a firearm frame defining a threaded bore;

an elongated clamp element having a first end adapted to adjustably connect to the bore;

the clamp element having an opposed second end having an enlarged head;

the clamp element having an elongated shaft between the first end and second end and having a shaft width a plurality of plates each defining an opening receiving the clamp element;

each opening being larger that the shaft width;

the plates arranged in a stack between the head and the firearm frame; and the claim element being operable to transition between a first released position in which the plates are free to move transversely with respect to each other, and a second clamped position in which the plates are secured against movement with respect to each other, such that the stack may be formed into a selected shape when the claim is in the released position, and are held in the selected shape when the clamp is in the clamped position.

15. The firearm of claim 14 wherein the plates each have an orienting feature, and wherein the plates are stacked in alternating configuration with a first subgroup of plates interleaved with a second subgroup of plates, and wherein the orienting feature of the first subgroup is oriented in a first orientation, and the orienting feature of the second subgroup is oriented in a different second direction.

16. The firearm of claim 15 wherein the first orientation is opposite the second direction.

17. The firearm of claim 15 wherein the orienting feature is a spring having a biasing direction.

18. The firearm of claim 15 wherein the plates each have a contact edge and an opposed recessed edge, and wherein the contact edge of each plate extends beyond the recessed edge of an adjacent plate in the stack.

19. The firearm of claim 14 wherein each plate includes a spring element operable to bias the plate in a selected direction.

* * * * *